United States Patent [19]

Gerwin

[11] 4,157,685

[45] Jun. 12, 1979

[54] WARHEAD FUZE SEEKER

[75] Inventor: Harry L. Gerwin, Bethesda, Md.

[73] Assignee: The United States of America as represented by the Secretary of the Army, Washington, D.C.

[21] Appl. No.: 507,639

[22] Filed: Nov. 9, 1965

[51] Int. Cl.[2] ..... F42C 13/04

[52] U.S. Cl. ..... 102/214

[58] Field of Search ..... 102/70.2 P, 67, 57, 102/70.2; 343/7 PF, 771, 7

[56] References Cited

U.S. PATENT DOCUMENTS 3,136,251 6/1964 Witow ..... 102/213

*Primary Examiner*—Charles T. Jordan

*Attorney, Agent, or Firm*—Nathan Edelberg; Robert P. Gibson; Saul Elbaum

[57] ABSTRACT

An interceptor missile has a single gimbal system mounted in its interior. The single gimbal system positions a directional warhead carried by the missile to provide the maximum destructive effect upon detonation to an air supported target.

2 Claims, 2 Drawing Figures

WARHEAD FUZE SEEKER

The invention described herein may be manufactured and used by or for the Government of the United States of America for governmental purposes without the payment to me of any royalty thereon.

This invention generally relates to a fragmentation warhead fuze system for medium range interceptor missiles and rockets which are intended for deployment against air supported targets, and more particularly to an improved non-nuclear warhead fuze seeker system for such missiles and rockets.

In defending against enemy aircraft, it has long been recognized that it is necessary for effective defense to explode an antiaircraft missile warhead when it comes within a certain range of the target rather than rely on the possibility of a direct hit. The proximity fuze was first developed during World War II and was exceeded in importance and security effort only by the atomic bomb. The success of the proximity fuze and the potent military advantage it gave the Allied forces is now well recorded history. Since that time, considerable effort and expenditure has been made to further develop and adapt proximity fuzes for various applications. Most proximity fuze systems have heretofore relied solely on detonation of an omnidirectional warhead when the target is detected within the range of the warhead blast pattern to produce a kill. While this has proved entirely satisfactory in the past, the increased speeds of potential targets make the probability of a kill less than is now desired for adequate tactical defense. These increased speeds have produced two critical problems in design. First, since the encounter time of the interceptor missile with its intended target is greatly reduced, the fuze must be more sensitive than before. Second, the closest approach distance between the interceptor missile and the target is usually greater than with slow moving targets necessitating warheads with far larger blast patterns. Considerable attention has been devoted to the first of these problems with the result that many highly sensitive proximity fuze detectors have been developed. The second problem, however, has received only a modicum amount of research effort. It is also further complicated by the requirement that the warhead of a tactical weapon be "conventional" or non-nuclear. Obviously, there is a practical limit to the size of the fragmentation blast pattern than can be realized from a non-nuclear warhead. Recently, warheads have been developed which have highly directional fragmentation blast patterns. The motivation for this development work was the recognition that omnidirectional warheads are necessarily highly inefficient and that the range of the blast could be greatly increased if all the energies of the explosion are made to act in substantially the same direction. It has been proposed that an interceptor missile deployed against a potential air-supported target could be made more effective if it employed such a directional blast fragmentation warhead. This scheme requires that some means be provided whereby the axis of the fragmentation blast pattern of the warhead is aligned with the line-of-sight from the interceptor missile to the target. One attempt to provide an armament system for a missile using a directional blast warhead mounts the warhead in a gimbaled system in the nose of the missile. Ahead of the warhead in another gimbaled system is a fuze seeker system which provides pointing information and the time to fire. This solution, while having many appealing features, suffers several serious drawbacks which makes it somewhat unpractical in an operational weapons system. First of all, it is necessary to remove the fuze seeker system prior to firing so that it will not interfere with the blast pattern of the warhead. In addition, the servo lag between the seeker position and the warhead position introduces an uncertain error. There is also a low-reliability factor associated with multi-gimbaled systems. Finally, multi-gimbaled systems are expensive, bulky and heavy.

It is therefore an object of the instant invention to provide a fragmentation warhead fuze seeker system having improved system performance and increased reliability.

It is another object of this invention to provide a fuze system for a non-nuclear directional blast warhead which is simpler to manufacture and more compact in construction than heretofore proposed fuze seeker systems.

It is a further object of the invention to provide an improved fuze seeker system for medium range interceptor missiles and rockets that does not require removal or jettisoning prior to firing the warhead.

According to the present invention, these and other objects are accomplished by providing within an interceptor missile a single gimbaled system which supports and positions a directional blast warhead. The antenna for the fuze seeker is fabricated of a metallic-plated, low-density plastic foam and mounted on the front face of the warhead. The local oscillator and other accessories which are part of the gimbaled seeker system are mounted on the back of the warhead.

The specific nature of the invention, as well as other objects, uses and advantages thereof, will clearly appear from the following description and from the accompanying drawing, in which.

Figure 1:
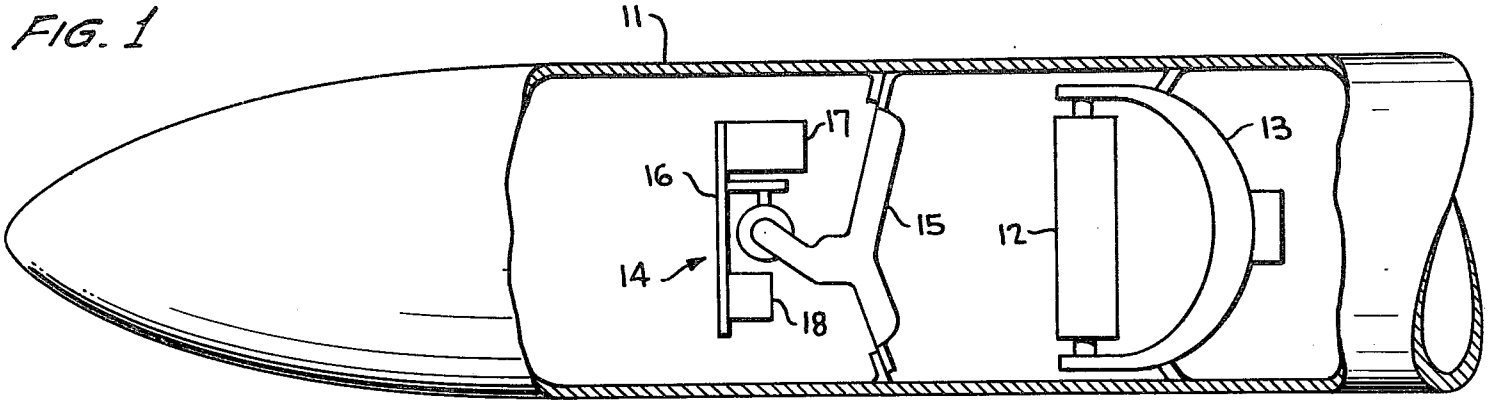
FIG. 1 is a side view, partially broken away, of the nose of an intermediate interceptor missile showing the fuze seeker system and the warhead mounted in separate gimbaled systems.

Refering now to the drawing, and more particularly to FIG. 1, there is shown a nose section 11 of an interceptor missile which employs a fuze seeker system for a directional fragmentation warhead. The warhead 12 is supported and positioned by a gimbaled system 13 within the nose section 11. Also within the nose section 11 and forward of the warhead 12 is a fuze seeker system 14 which is mounted in a gimbaled system 15. The fuze seeker system includes a planar, slotted wareguide antenna 16 the back surface of which serves as a rigid supporting plate for the various components 17, 18 of the fuze seeker system such as the local oscillator, detonator circuit, and servo amplifiers. The fuze seeker system 14 may be any well known design. It is merely necessary that the fuze seeker system drive the gimbaled system 15 to position antenna 16 to receive the maximum reflected signal from the target. The gimbaled system 13 is slaved to the gimbaled system 15 thereby causing the fragmentation axis of warhead 12 to be substantially aligned with the axis of the main lobe of antenna 16 as the fuze seeker 14 tracks the target. There are two sources of directional error inherent in the slaved system depicted. The first is a parallax error since the axes of the warhead 12 and the fuze seeker system 14 are not aligned but in one direction. This, however, is easy to correct for any given distance to the target as determined by the detonator circuit. For example, a fixed parallax correction may be incorporated into the servo drive of the gimbaled system 13, the parallax correction being correct for the desired distance to the target at the time the warhead 12 is fired. The second source of error results from the servo lag between the slaved gimbaled system 13 and gimbaled system 15. This is a complex error resulting from a number of variables including slewing speed and position sensing error of the servo systems. As a result, it is difficult at best to even partially compensate for this source of error. Perhaps the greatest problem with the fuze seeker system shown in FIG. 1 is the need to remove the fuze seeker 14 and its gimbaled system 15 prior to firing the warhead 12. This is necessary to prevent the solid mass of the various components such as the waveguide structures, servo motors, etc. associated with the fuze seeker assembly from obstructing the blast and thereby adversely affecting the blast pattern of the warhead. While this may be accomplished by jettisoning the forward portion of the missile nose containing the fuze seeker assembly just prior to detonation, the resulting missile system is both complex and costly.

Figure 2:
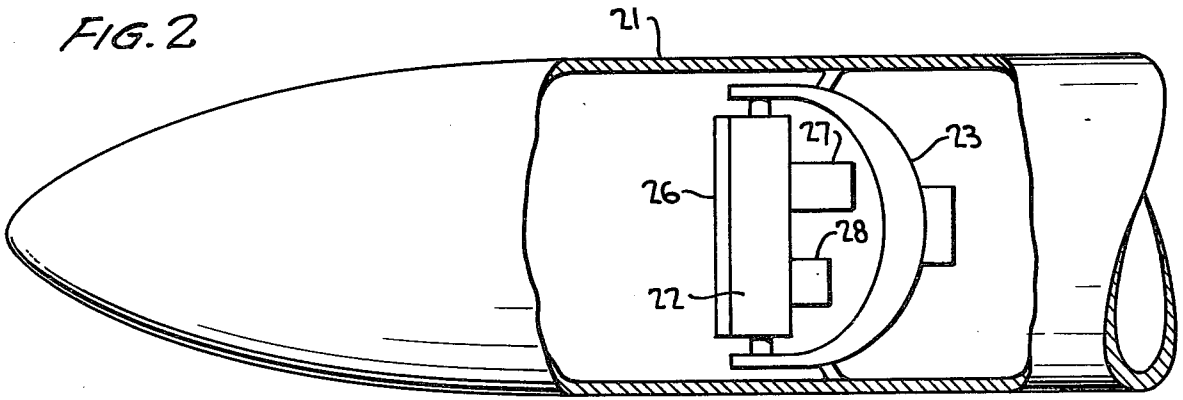
FIG. 2 is a similar view to that of FIG. 1 showing the fuze seeker system and warhead mounted in a single gimbaled system according to the invention.

The improvement according to this invention obviates these various disadvantages and at the same time greatly increases the reliability of the missile armament system by eliminating one of the gimbaled systems. The way in which this is accomplished is shown in FIG. 2. A directional fragment action warhead 22 is supported and positioned within the missile nose section 21 by a gimbaled system 23 as before. Mounted on the face of warhead 22 is a planar, slotted waveguide antenna 26. Antenna 26, however, is not of conventional design but rather is a special waveguide structure having sufficiently low density that it will not degrade the functional performance of warhead 22 if left in place when the warhead is fired. This antenna was developed specifically for this application at the Harry Diamond Laboratories and is the subject of copending patent application Ser. No. 482,955, filed Aug. 26, 1965, by Howard S. Jones and Richard J. Norris, and assigned to the assignee of the instant application. Copending application Ser. No. 482,955, entitled "Copperplated Foam Dielectric Antenna and Waveguide Components and Method of Making the Same," fully describes the structure and manufacture of antenna 26; however, a brief description is included here in order that the significance of the present invention may be more completely appreciated. A section of low-density plastic foam, such as foam polyurethane, is machined so that its external dimensions duplicate the internal dimensions of the conventional slotted wareguide antenna 16 in FIG. 1. The positions of the antenna radiating slots are masked on the machined foam polyurethane section, and then the foam polyurethane section is copper plated. Removal of the slot masks yields an antenna with approximately the same physical dimensions and the same electrical characteristics as the conventional waveguide antenna which it replaces. Continuing now and with reference again to FIG. 2, the other components 27, 28 of the system are mounted on the aft face of the warhead 22 and completely out of the way of the blast. It should be obvious that the invention increases the reliability of the missile armament system because one gimbaled system and its associated servo systems have been eliminated. Over-all system is also improved because the servo lag between the seeker position and the warhead position is eliminated as a source of error. Further the removal of the seeker head prior to warhead function is no longer required. The resulting armament system is lighter in weight and more compact in construction thus allowing a shorter missile design.

It will be apparent that the embodiments shown are only exemplary and that various modifications can be made in construction and arangement within the scope of the invention as defined in the appended claims.

I claim as my invention:

1. In a medium range interceptor missile for deployment against air supported targets, said missile having a directional blast fragmentation warhead fuze seeker system comprising a gimbaled system for supporting and positioning the warhead within the nose section of the missile and a proximity fuze seeker system which senses the intended target, controls the gimbaled system through a servo system whereby the axis of the fragmentation blast pattern of the warhead is aligned with the line-of-sight from the interceptor missile to the target, and fires the warhead when the interceptor missile is a predetermined distance from the target, the improvement comprising:

(a) a copper-plated, plastic foam waveguide antenna permanently mounted forward of the warhead and connected to the proximity fuze seeker system for radiating and receiving electromagnetic energy in the direction of the target, said antenna having a sufficiently low density as not to degrade the functional performance of the warhead thereby obviating the necessity of removing said antenna prior to firing the warhead, and (b) the remaining high-density components of the proximity fuze seeker system being mounted aft of said warhead within the missile.

2. The improvement recited in claim 1 wherein said antenna is directly mounted on the forward face of the warhead.

* * * * *